US005111507A

United States Patent [19]

Nakaji

[11] Patent Number: 5,111,507

[45] Date of Patent: May 5, 1992

[54] SYSTEM FOR REDUCING NOISE LEVEL IN VEHICULAR CABIN

[75] Inventor: Yoshiharu Nakaji, Yokosuka, Japan

[73] Assignee: Nissan Motor Company, Limited, Yokohama, Japan

[21] Appl. No.: 556,541

[22] Filed: Jul. 24, 1990

[30] Foreign Application Priority Data

Jul. 24, 1989 [JP] Japan ..... 1-190905

[51] Int. Cl.[5] ..... G10K 11/16

[52] U.S. Cl. ..... 381/71

[58] Field of Search ..... 381/71, 86

[56] References Cited

U.S. PATENT DOCUMENTS 4,506,380 3/1985 Matsui ..... 381/71

4,689,821 8/1987 Salikuddin et al. ..... 381/71

FOREIGN PATENT DOCUMENTS 0006292 1/1979 Japan ..... 381/71

0074400 4/1988 Japan ..... 381/71

2126837 3/1984 United Kingdom ..... 381/71

*Primary Examiner*—Forester W. Isen

*Attorney, Agent, or Firm*—Foley & Lardner

[57] ABSTRACT

A system for lowering noise level in a vehicular cabin produces an acoustic vibration canceling noise creative vibration induced in synchronism with an engine revolution. The system generates a rectangular wave signal having 50% duty cycle. The system includes means for producing a periodic signal having an interval half of a period of the noise created by vibration. The signal level of the rectangular signal is switched between HIGH and LOW levels alternatively at the time of occurrence of the periodic signal.

10 Claims, 6 Drawing Sheets

SYSTEM FOR REDUCING NOISE LEVEL IN VEHICULAR CABIN

BACKGROUND OF THE INVENTION

Field of the Invention

The present invention relates generally to a system for lowering noise level in a vehicular cabin. Particularly, the invention relates to a system for canceling noise created by acoustic vibration generated in synchronism with an engine revolution by generating acoustic vibration suppressing or at least reducing amplitude of the noise created by the acoustic vibration.

A system for canceling noise created by acoustic vibration, which will be hereafter referred to as "noise vibration", by generating acoustic vibration which will be hereafter referred to as "noise canceling vibration" adapted for at least partly canceling noise created by acoustic vibration, has been disclosed in Japanese Utility Model First (unexamined) Publication (Jikkai) Showa 62-127052. In this prior proposal, a rectangular wave signal is generated in relation to a spark ignition signal in the form of a pulse signal, because the spark ignition signal has a period corresponding to the noise vibration. In order to maintain the duty cycle of the rectangular pulse at 50%, a pulse width of the rectangular wave signal is set at a half of an interval of leading edges of the spark ignition pulses in the immediately preceding cycle.

The rectangular wave signal thus generated is subject to phase treatment and then converted into a sine wave signal. The sine wave signal is amplified by an amplifier. A control signal for performing amplification for the sine wave signal is an analog signal derived through a digital-to-analog conversion.

In such prior proposed system, a microprocessor is used for processing the spark ignition pulses for deriving the pulse width in order to maintain the duty cycle of the rectangular wave signal substantially at 50%. Furthermore, a digital-to-analog converter for forming the analog control signal is required. Both of the microprocessor and the digital-to-analog converter are relatively expensive resulting in a high cost of the overall system. On the other hand, when amplification of the sine wave signal is performed by an analog amplifier, fluctuation of linearity and phase characteristics of amplification degree can become unacceptable.

SUMMARY OF THE INVENTION

Therefore, it is an object of the present invention to provide a system for lowering noise level in a vehicular cabin, which system can be produced with reduced cost.

Another object of the present invention to provide a system for lowering noise level in a vehicular cabin, which can avoid any influence of tolerances in the characteristics of components and secular variation.

In order to accomplish aforementioned and other objects, a system for lowering noise level in a vehicular cabin produces an acoustic vibration canceling noise created by vibration induced in synchronism with an engine revolution. The system generates a rectangular wave signal having 50% duty cycle. The system includes means for producing a periodic signal having an interval which is half of the period of the noise created by vibration. The signal level of the rectangular signal is switched between HIGH and LOW levels alternatively at the time of occurrence of the periodic signal.

According to one aspect of the invention, a system for lowering noise level in a vehicular cabin, comprises:

first means for periodically generating a first pulse signal in synchronism with an engine revolution, the first pulse signal having a pulse period half of a period of the noise created by vibration induced in synchronous with engine revolution; second means, in response to the first pulse signal, for generating a rectangular wave signal which switches between a first lower level and a second higher level alternatively at every occurrence of the first pulse signal;

third means for converting the rectangular wave signal into a digital signal representative thereof;

fourth means for processing the digital signal for adjusting signal phase and amplitude and outputting adjusted digital signal having an adjusted amplitude and reproducing an acoustic vibration having frequency and amplitude represented by the adjusted digital signal for canceling the noise created by vibration.

The system may further comprise fifth means for monitoring an engine driving condition for providing an engine driving condition indicative data, and the fourth means deriving magnitude of phase shift and amplitude on the basis of the engine driving condition indicative data. Also, the system may further comprise a filtering means for receiving the adjusted digital signal and removing high harmonic component superimposing thereon.

The first means may generate the first pulse signal with an interval half of an interval of a crank reference signal. On the other hand, the third means converts the rectangular wave signal into digital signal by calculating AND of the rectangular wave signal and a sampling pulse.

In the preferred construction, the filtering means comprises a plurality of band-pass filters having mutually different pass-bands. Furthermore, the filtering means comprises at least a first filter having minimum pass band corresponding to minimum frequency of the noise created by vibration and a predetermined maximum pass-band, and a second filter having a minimum pass-band corresponding to the maximum pass-band of the first filter.

The first means may comprise a crank angle sensor producing a periodic signal in synchronism with the engine revolution, and the fifth means comprises means for deriving an engine speed data on the basis of the periodic signal. In such case, the fifth means receives an engine load data for deriving the magnitude of phase and adjusting magnitude of amplitude adjustment on the basis of the engine speed data and the engine load data. The engine load data may be a fuel injection control signal.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
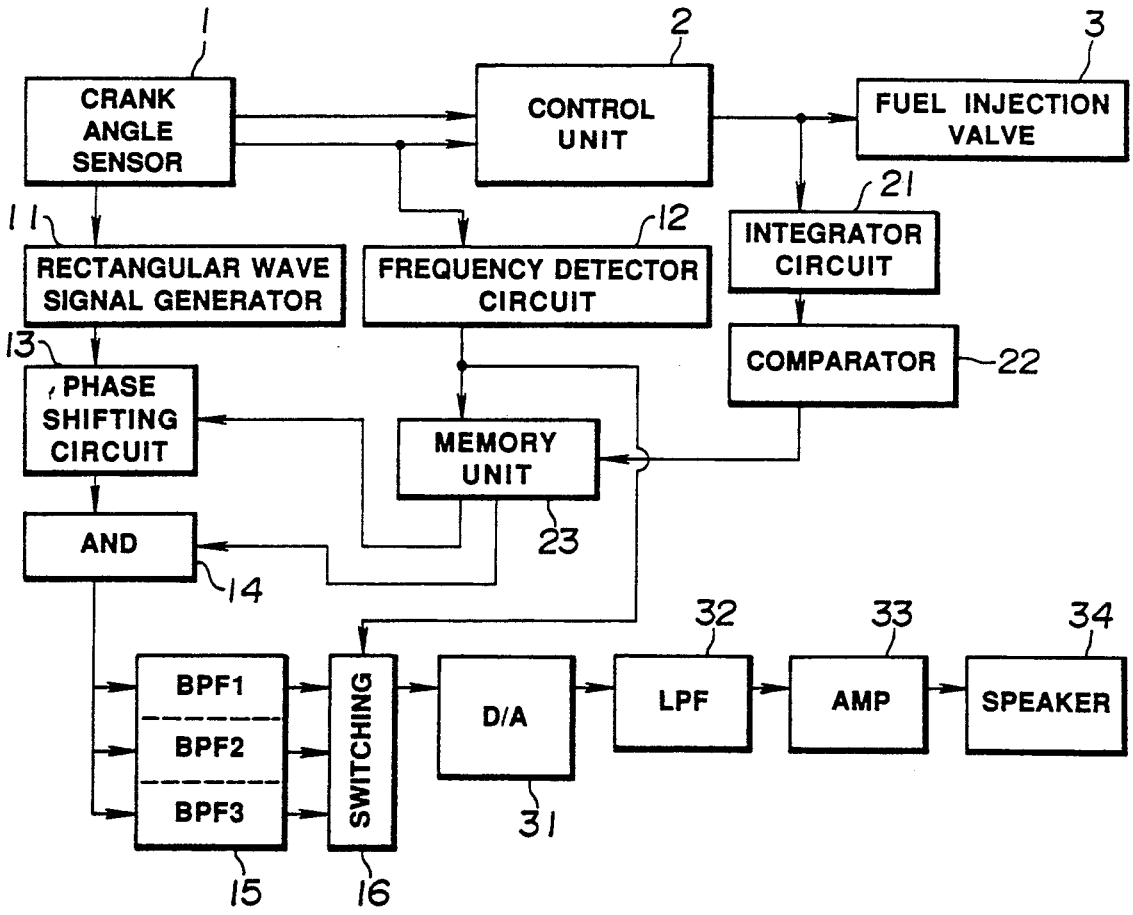
FIG. 1 is a block diagram of the first embodiment of a cabin noise level lowering system according to the present invention.

Referring now to the drawings, particularly to FIG. 1, the first embodiment of a cabin noise level lowering system, according to the present invention, includes a crank angle sensor 1. As is well known, the crank angle sensor 1 monitors angular position of a crankshaft (not shown) to produce a crank reference signal at every predetermined angular position, e.g. 60° before top-dead-center 60° BTDC, and a crank position signal at every predetermined angular displacement, e.g. 1°. The crank angle sensor 1 employed in the shown embodiment further produces a pulse signal having a pulse period corresponding to 90° of crankshaft angular displacement, which pulse signal will be hereafter referred to as "90° signal". Therefore, in case of a 4-cylinder engine, the 90° signal is generated within half period of the crank reference signal. As is well known, the crank reference signal and the crank position signal are used for controlling fuel injection, spark ignition timing and so forth. For this purpose, the crank reference signal and the crank position signal are fed to an engine control unit 2 which basically comprises a microprocessor. The crank position signal is also fed to a frequency detector circuit 12.

Figure 5:
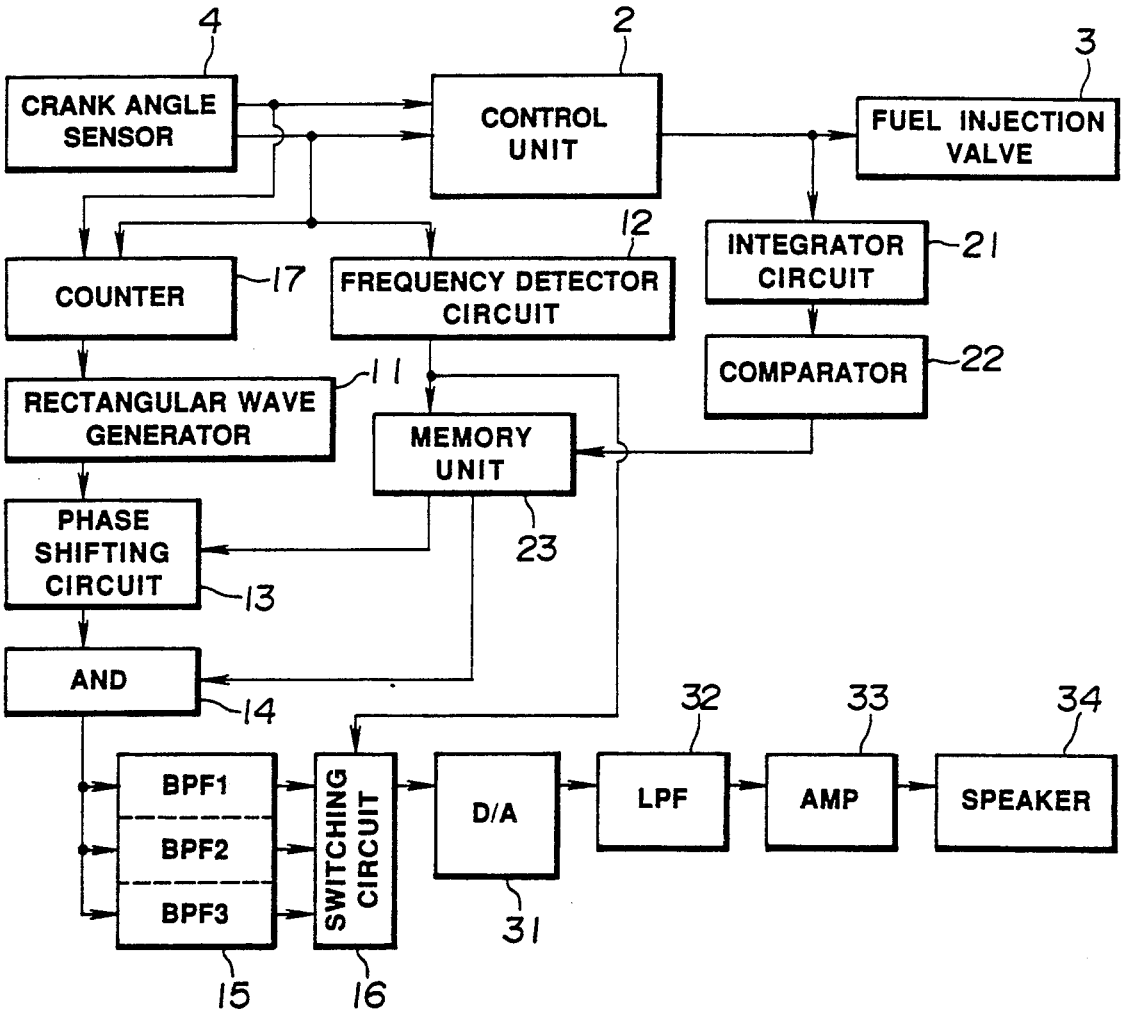
FIGS. 5 and 6 are block diagrams respectively showing second and third embodiments of the cabin noise level lowering system according to the invention.

It should be appreciated that though the shown embodiment of the crank angle sensor 1 outputs 90° signal in addition to the crank reference signal and the crank position signal, it may be possible to neglect the 90° signal to be produced by the crank angle sensor. In such case, as shown in FIG. 5, a counter 17 is provided to count up the crank position signal with resetting the counter value in response to the crank reference signal so that the 90° signal is produced every 90° of crankshaft revolution. Alternatively, it is further possible to generate the 90° signal by frequency dividing of the crank position signal to produce the pulse form 90° signal every 90° of crankshaft angular displacement.

The frequency detector circuit 12 comprises a kind of counter designed for counting up the crank position signal input within a predetermined unit time. Based on the counter value, the frequency detector circuit 12 derives an engine speed representative data in a form of digital signal.

It should be appreciated that though the shown embodiment utilizes the crank position signal for deriving the engine speed data, it is possible to use the crank reference signal for deriving the engine speed, since the pulse period of the crank reference signal is inversely proportional to the engine revolution speed.

Figure 2:
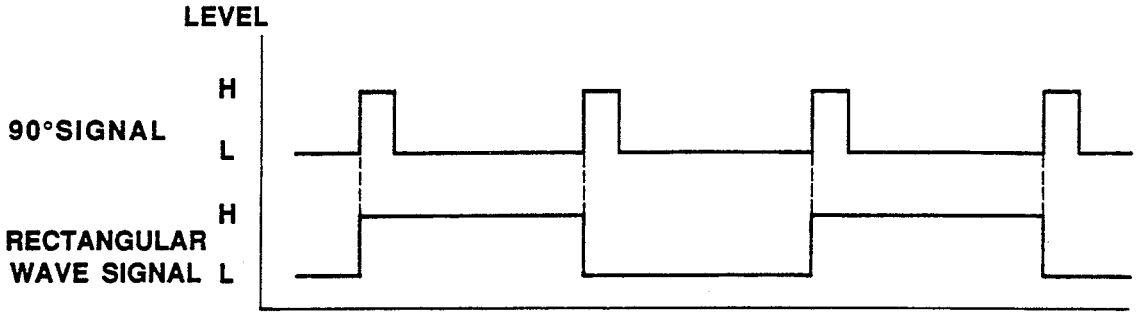
FIG. 2 is a timing chart showing operation of a rectangular wave generating circuit in the first embodiment of the cabin noise lowering system of FIG. 1.

A rectangular wave generator circuit 11 receives the 90° signal from the crank angle sensor 1 or in the alternative from the counter 17. The rectangular wave generator circuit 11 comprises a flip-flop circuit and a circuit for generating a digital output signal. As shown in FIG. 2, the flip-flop circuit of the rectangular wave generator circuit 11 is responsive to the leading edge of the 90° signal to switch the state between the set and reset states. Therefore, as can be seen from FIG. 2, the output signal level of the rectangular wave generator circuit 11 is alternated between HIGH and LOW levels with an interval corresponding to the interval of the leading edge of the 90° signal. The rectangular wave generator circuit 11 is further supplied a sampling clock from a clock generator (not shown). While the output level of the rectangular wave generator circuit 11 is maintained HIGH level, the digital signal is output in synchronism with the sampling clock.

In the shown embodiment, the control unit 2 produces a fuel injection control signal as a load signal, to be fed to a fuel injection valve 3. The fuel injection control signal is a pulse signal having a pulse width corresponding to the open period of the fuel injection valve 3. Therefore, the fuel injection control signal may reflect load condition on the engine. In the following discussion, the output of the control unit 2 will be referred to as "load signal" for the reasons set forth above.

Figure 3:
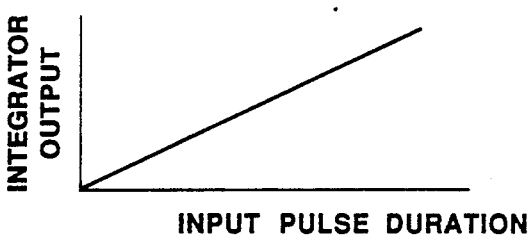
FIG. 3 is a chart showing characteristics of an integration circuit in the first embodiment of the cabin noise lowering system of FIG. 1.

The load signal output from the control unit 2 is delivered to the fuel injection valve 3 for controlling fuel injection timing and the fuel injection amount. Furthermore, the load signal of the control unit 2 is fed to an integrator circuit 21. The integrator circuit 21 generates an output signal having a voltage level proportional to the pulse width of the output signal of the rectangular wave signal generator circuit 11, as illustrated in FIG. 3. The integrator circuit 21 may be either analog circuit or digital circuit.

The output of the integrator circuit 21 is supplied to a comparator 22. The comparator 22, employed in the shown embodiment, is designed to compare the voltage level of the integrator output to produce a digital signal representative of the voltage level of the integrator output. As can be appreciated, though the input for the comparator is a voltage signal and a serial analog signal, the output of the comparator is discrete. By this, the digital form engine load indicative data can be derived.

The frequency detecting circuit 12 and the comparator 22 are connected to a memory unit 23 for storing the engine speed indicative data and the engine load indicative data. The memory unit 23 derives the phase information and amplitude information on the basis of storage therein and supplies the information to a phase shifting circuit 13 and an AND gate 14. The phase shifting circuit 13 is responsive to the phase information supplied from the memory unit 23 for providing a given magnitude of delay for the rectangular wave signal supplied from the rectangular wave generator circuit 11. Since the rectangular wave signal is a digital signal, the phase information contains a value corresponding to a number of clocks over which the phase of the rectangular wave signal is delayed. On the other hand, the AND gate 14 is used for performing amplitude treatment. Namely, the AND gate 14 passes the amplitude information from the memory unit 23 only when the rectangular wave signal as delayed by the phase shifting circuit 13, is maintained at HIGH level. The amplitude information thus output from the AND gate represents amplitude of the noise canceling vibration.

Figure 4:
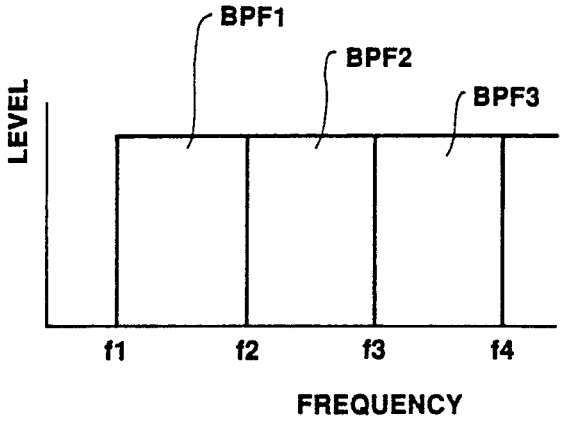
FIG. 4 is a chart showing frequency characteristics of a band-pass filter unit employed in the first embodiment of the cabin noise lowering system of FIG. 1.

The rectangular wave form output of the AND gate 14 is fed to a band-pass filter unit 15 including a plurality of band-pass filters $BPF_1$, $BPF_2$ and $BPF_3$. The respective band-pass filters $BPF_1$, $BPF_2$ and $BPF_3$ are designed to remove higher harmonic components in the rectangular wave signal. For this purpose, the band-pass filters $BPF_1$, $BPF_2$ and $BPF_3$ have a pass-band as illustrated in FIG. 4. In the shown chart, the frequency $f_1$ corresponds to the minimum frequency of the noise created by vibration to be canceled. Likewise, the frequency $f_2$ is set to satisfy ($f_2<2\times f_1$), the frequency $f_3$ is set to satisfy ($f_3<2\times f_2$) and the frequency $f_4$ is set to satisfy ($f_4<2\times f_3$). Practically, the band-pass filters can be constructed as finite impulse responsive filters (FIR filter) for setting the frequency characteristics at a desired characteristics. Namely, the phase characteristics of the band-pass filters are set for maintaining continuity of the phase characteristics at filter switching criteria, i.e. $f_2$ and $f_3$. By this, phase shift upon switching of filter can be successfully prevented.

Each of the band-pass filter $BPF_1$, $BPF_2$ and $BPF_3$ are connected to switching circuit 16. The output of the switching circuit 16 has a frequency corresponding to the noise created by vibration frequency which is variable depending upon the engine speed.

The switching circuit 16 feeds the output signal having the frequency corresponding to the noise created by vibration frequency to a digital-to-analog (D/A) converter 31, in which digital-to-analog (D/A) conversion is taking place to output an analog signal. The analog signal thus produced is fed to a speaker via a low-pass filter 32 and an amplifier 33.

It should be appreciated that the noise created by vibration has a vibration period corresponding to the engine revolution cycle. Therefore, by generating the rectangular wave signal having half a period of the noise created by vibration by the rectangular wave signal generator circuit 11, the rectangular wave signal having 50% of duty cycle can be formed. As can be appreciated herefrom, for generating the 50% duty cycle of the rectangular wave signal, the shown embodiment does not require process of microprocessor.

On the other hand, the rectangular wave signal is converted into digital signal representative of an amplitude of the rectangular wave signal. The digital signal thus generated is processed for adjusting phase shifting and amplification by the phase shifting circuit 13 and AND 14. Here, in contrast to analog signal processing, the digital signal processing as employed in the shown embodiment, may have lesser fluctuation of the characteristics and secular variation. Furthermore, since the data to be stored in the memory unit 23 is in the form of the digital signal, it becomes unnecessary to provide an extra D/A converter.

In addition, in the shown embodiment, with the combination of the band-pass filter 15 and the switching circuit 16, the frequency range to pass the rectangular wave signal can be selected depending upon the engine speed for successfully removing the higher harmonic frequency. That is, the rectangular wave signal output from AND gate 14 contains high level higher harmonic component. Namely, the output of the AND gate contains the signal component corresponding to several times of a reference frequency which corresponds to the vibration frequency of the noise creative vibration.

Practically, the noise created by vibration frequency can vary in a range of 1200 r.p.m. to 7200 r.m.p. This is converted into 40 Hz to 240 Hz in the 4-cylinder engine. Therefore, a single filter having a signal pass-band may allow passing of the high harmonic noise. According to the shown embodiment, this problem can be solved by providing a plurality of band-pass filters with mutually different frequencies, and thus removal of the high harmonics can be assured.

Figure 6:
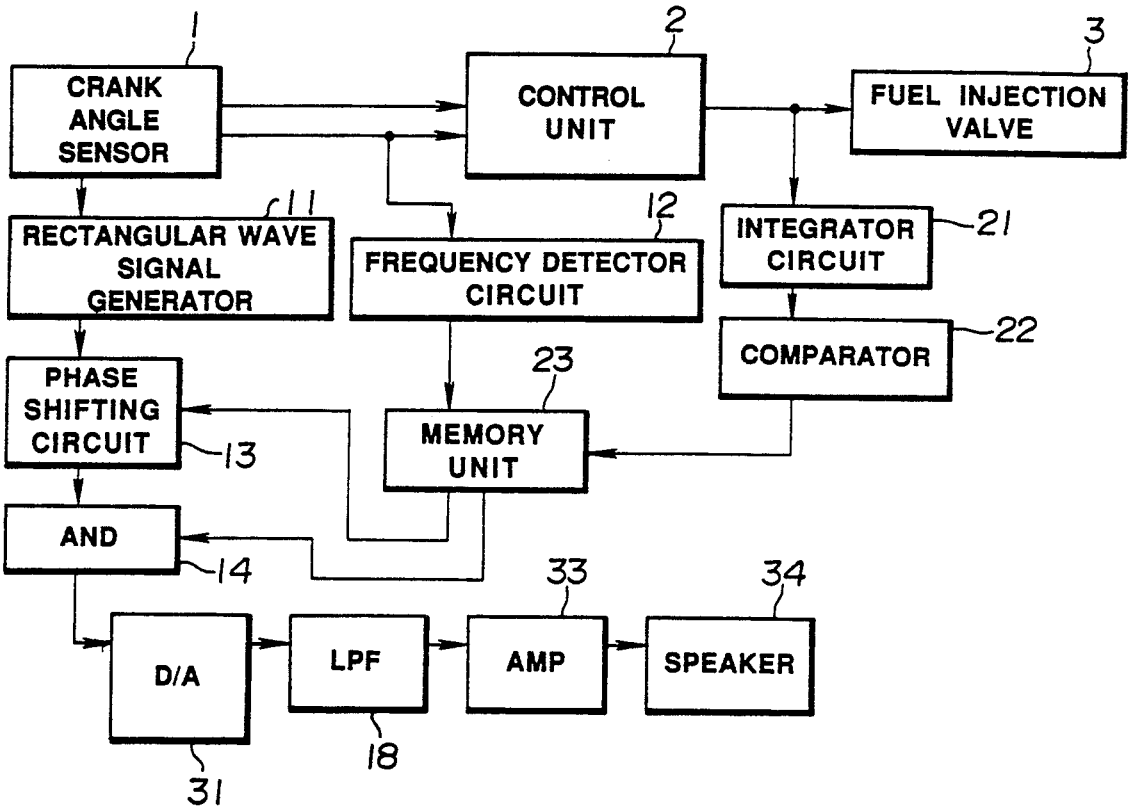

FIG. 6 shows another embodiment of the vehicular cabin noise lowering system according to the present invention. The shown embodiment is particularly applicable in a case where the frequency band of the noise created by vibration frequency is not as wide as that discussed above. Namely, the shown embodiment is applicable for the noise created by vibration having a frequency range, in which the maximum frequency is slightly higher than twice the minimum frequency. In the shown embodiment, the band-pass filter unit 15 and the switching circuit 16 are neglected. Therefore, the output of the AND gate 14 is directly supplied to the D/A converter 31.

Figure 7:
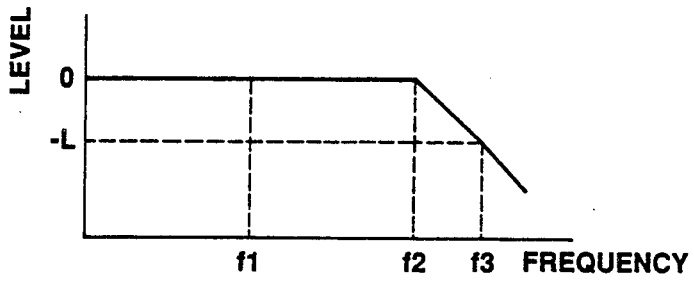
FIG. 7 is a chart showing characteristics of low-pass filter in the system of FIG. 6.

In the shown embodiment, a low-pass filter 18 as an analog filter having filter characteristics as illustrated in FIG. 7 is employed in place of the low-pass filter 32 as in the former embodiments. As can be seen from FIG. 7, the pass band of the low-pass filter 18 is set to have a minimum frequency $f_1$ substantially corresponding to the minimum frequency of the noise created by vibration and the frequency $f_2$ less than the twice of the minimum frequency $f_1$. On the other hand, the frequency $f_3$ is set to be equal to twice of the minimum frequency $f_1$. Namely, when the rectangular wave signal having the reference frequency corresponding to the minimum frequency $f_1$, the frequency component having a frequency which is a multiple of the reference frequency is lowered in a magnitude of L dB. Therefore, by selecting L properly, the noise created by vibration will not significantly degrade the silence level of the vehicular cabin even when the vibration enters thereinto. In addition, for the noise created by vibration in a frequency range above $f_2$, the amplitude may be adjusted by increasing the amplitude represented by the amplitude information provided by the memory unit 23 in view of the lowering magnitude by the low-pass filter.

Figure 8:
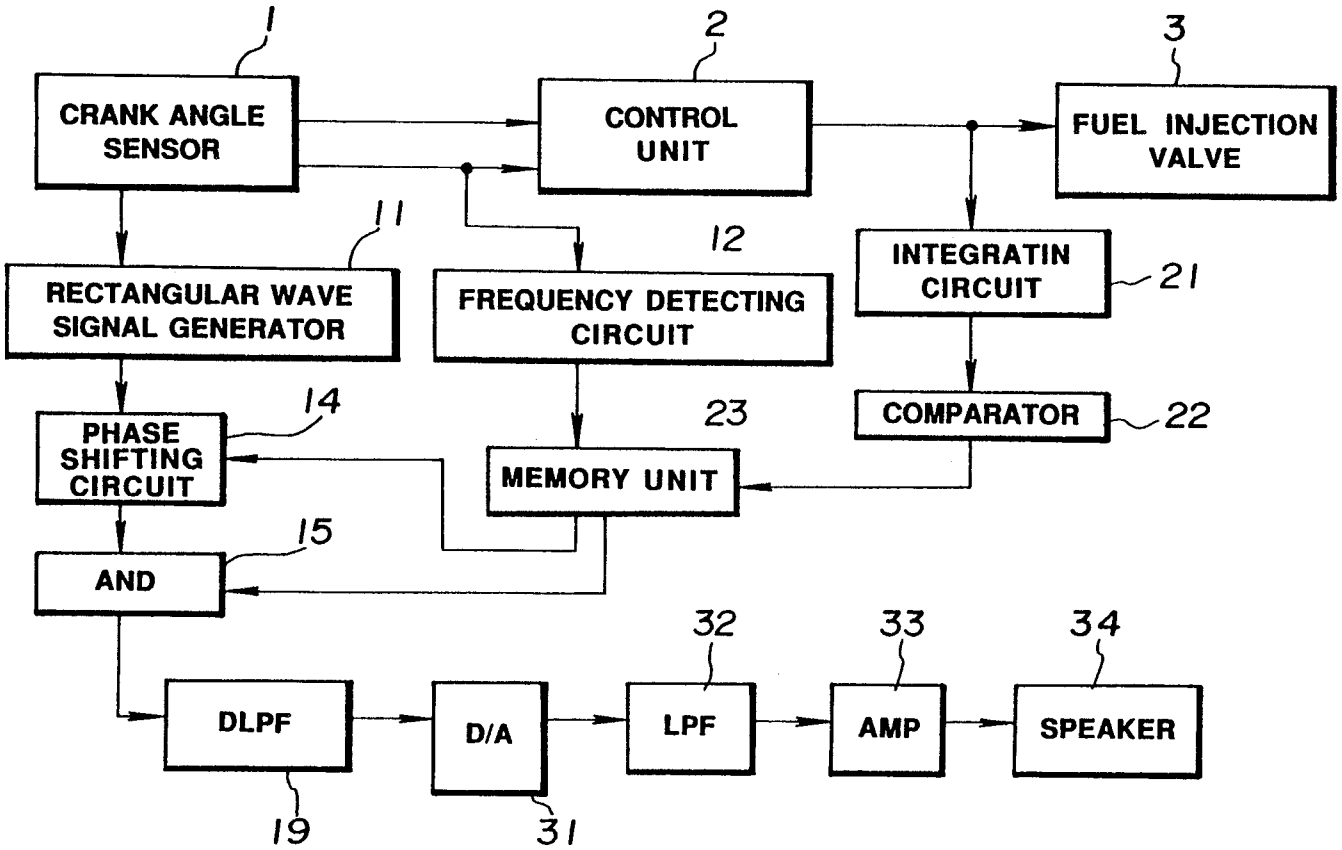
FIG. 8 is a block diagram of the fourth embodiment of the cabin noise level lowering system according to the invention.

In another application, the low-pass filter employed in the embodiment of FIG. 6 may be replaced with a digital low-pass filter (DLPF) 19 as shown in FIG. 8.

Figure 9:
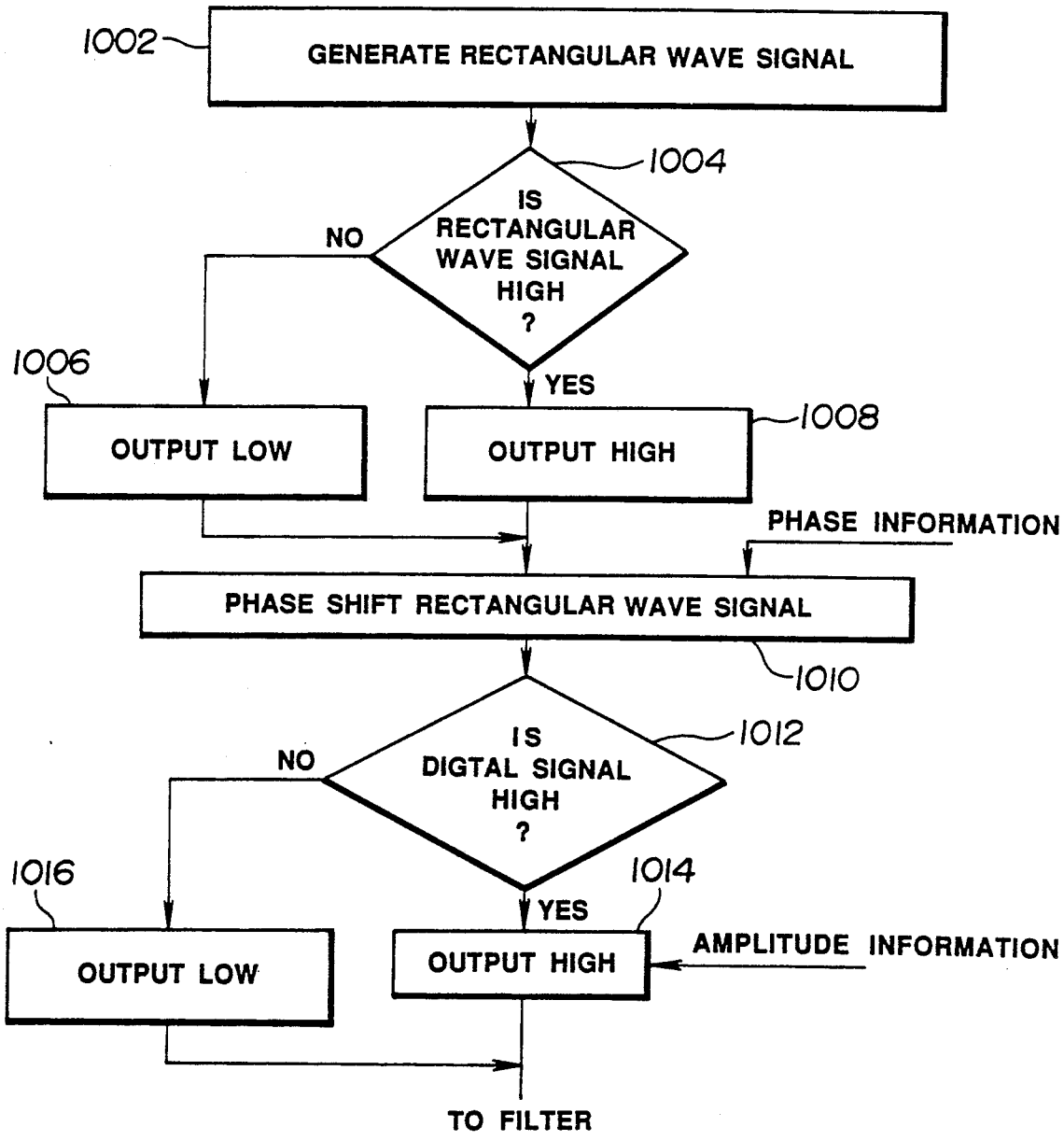
FIG. 9 is a flowchart showing process to be commonly performed by all embodiments of the cabin noise level lowering systems.

FIG. 9 shows a flowchart showing a process common to all embodiments of the vehicular cabin noise lowering system according to the invention.

As can be seen herefrom, the process of generation of the rectangular wave signal is initiated in response to the 90° signal. Then, at a step 1002, a rectangular wave signal having a duty cycle determined by the interval of the leading edges of the 90° signals, is derived. Then, judgement is made at a step 1004, whether the instantaneous signal level of the rectangular wave signal is HIGH level or not. Depending upon the result of the judgement made at the step 1004, HIGH and LOW level is output from the rectangular wave generator circuit 11 at steps 1006 and 1008. Then, at a step 1010, based on the phase information which may be derived on the basis of the engine speed indicative data and the engine load indicative data, from the memory unit 23, phase shift is provided for the rectangular wave signal supplied to the phase shifting circuit 13 from the rectangular wave generator circuit 11.

Then, check is performed at a step 1012; to determine whether the phase shifted rectangular wave signal is in HIGH level or not. While the phase shifted rectangular wave signal is maintained at HIGH level, the AND gate 14 is enabled to pass the amplitude information which represents amplitude of the noise canceling vibration at a step 1014. Otherwise, the AND gate 14 outputs LOW level signal at a step 1016.

The rectangular wave signal containing information representative of the amplitude of noise canceling vibration is then fed to the filtering process and reproduction process as set out above.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

For example, in the foregoing embodiment, the phase information and the amplitude information are stored in the memory unit and read out in terms of the engine speed data and the engine load data, it is possible to derive phase information and the amplitude information by feeding back noise level data representative of the noise level in the vehicular cabin.

Furthermore, since the shown embodiments are discussed in terms of the 4-cylinder engine having 180° of interval of the crank reference signal, the 90° signal is used for deriving the duty cycle of the rectangular wave signal initially produced in the rectangular wave signal generator circuit. However, in case of the 6-cylinder and 8-cylinder engine, the intervals of the crank reference signals are respectively 120° and 90°. Therefore, the pulse signal to determine the signal level of the rectangular wave signal to be generated by the rectangular wave signal generator circuit should be produced every 60° and 45°, so as to establish 50% duty cycle of rectangular wave signal.

What is claimed is:

1. A system for lowering cabin noise in a vehicular cabin, comprising:

first means for periodically generating a first pulse signal in synchronism with an engine revolution, said first pulse signal having a period proportional to a noise period created by vibration induced in synchronization with said engine revolution;

second means including a flip-flop, in response to the first pulse signal, for generating a rectangular waveform signal having a 50% duty ratio and a rising edge and falling edge being in conformity to a rising edge and subsequent rising edge of said first pulse signal, respectively;

third means for converting said rectangular waveform signal into a digital signal representative thereof; and fourth means for processing said digital signal for adjusting signal phase and amplitude and outputting adjusted digital signal for canceling the noise created by vibration.

2. A system as set forth in claim 1, which further comprises fifth means for monitoring an engine driving condition and providing an engine driving condition indicative data, and said fourth means deriving magnitude of phase shift and amplitude on the basis of said engine driving condition indicative data.

3. A system as set forth in claim 1, which further comprises a filtering means for receiving said adjusted digital signal and removing a high harmonic component superimposed thereon.

4. A system as set forth in claim 1, wherein said first means generates said first pulse signal with an interval half of an interval of a crank reference signal.

5. A system as set forth in claim 1, wherein said third means converts said rectangular wave signal into digital signal by calculating AND of said rectangular wave signal and a sampling pulse.

6. A system as set forth in claim 3, wherein said filtering means comprises a plurality of band-pass filters having mutually different pass-bands.

7. A system as set forth in claim 6, wherein said filtering means comprises at least a first filter having minimum pass-band frequency corresponding to minimum frequency of said noise created by vibration and a predetermined maximum pass-band frequency, and a second filter having a minimum pass-band frequency corresponding to the maximum pass-band frequency of said first filter.

8. A system as set forth in claim 2, wherein said first means comprises a crank angle sensor producing a periodic signal in synchronism with the engine revolution, and said fifth means comprises means for deriving engine speed data on the basis of said periodic signal.

9. A system as set forth in claim 8, wherein said fifth means comprises receiving engine load data for deriving magnitude of phase adjustment and magnitude of amplitude adjustment on the basis of said engine speed data and said engine load data.

10. A system as set forth in claim 9, wherein said engine load data is a fuel injection control signal.

* * * * *